United States Patent [19]

Psyras

[11] 4,302,901

[45] Dec. 1, 1981

[54] AERODYNAMIC TOY

[76] Inventor: Louis G. Psyras, 1384 Commonwealth Ave., Boston, Mass. 02135

[21] Appl. No.: 141,174

[22] Filed: Apr. 17, 1980

[51] Int. Cl.[3] ..... A63H 27/00

[52] U.S. Cl. ..... 46/74 D; 273/424; D21/86

[58] Field of Search ..... 46/74 D. 228; 273/424, 273/425, 428; D21/86, 85

[56] References Cited

U.S. PATENT DOCUMENTS

| | | | |
|---|---|---|---|
| D. 208,334 | 8/1967 | Gerds | D21/86 X |
| 3,613,295 | 10/1971 | Everett | 46/74 D |
| 3,724,122 | 4/1973 | Gillespie, Sr. | 46/74 D |
| 4,045,029 | 8/1977 | Katzmark | 273/425 |
| 4,183,168 | 1/1980 | Ross | 46/74 D |

FOREIGN PATENT DOCUMENTS

| | | | |
|---|---|---|---|
| 467331 | 12/1951 | Italy | 46/74 D |

OTHER PUBLICATIONS

The Involute, *A Manual of Engineering Drawing,* Thomas E. French, McGraw-Hill Book Co., Inc., 1941, p. 75.

*Primary Examiner*—Gene Mancene
*Assistant Examiner*—Mickey Yu
*Attorney, Agent, or Firm*—Herbert L. Gatewood

[57] ABSTRACT

An aerodynamic toy having a circular-shaped rotatable, free-flight body of generally convex/concave shape is provided. A downwardly extending rim portion integral with and forming a smooth continuous curve with the body acts in flight as a primary air foil. Spiral-shaped air spoilers are provided on the upper surface of the convex-shaped body.

17 Claims, 3 Drawing Figures

AERODYNAMIC TOY

BACKGROUND OF THE INVENTION

1. Field of the Invention

This invention relates in general to an aerodynamic toy and, in particular, to such a toy of novel configuration, to be thrown by hand through the air.

2. Description of the Prior Art

Aerodynamic toys resembling so-called "flying saucers", and which are thrown by hand with a wrist-snapping action, have gained ever increasing popularity in the past several years. The wrist-snapping action imparts a spinning motion to the toy, as it flies through the air. The direction of flight from the thrower, in general, depends upon the thrower's skill, and the type of flight path (i.e., whether curved or straight) depends somewhat upon the angle of the aerodynamic toy in relation to the ground, when it is released by the thrower. These "flying saucers", or aerodynamic toys, fly as they do, i.e, when released approximately horizontal to the ground, apparently because they approximate an air foil. Hence, the toy's flight through the air is enhanced by aerodynamic lift.

Various toys of this type have been developed over the past several years, and they have been enjoyed by the young, and the not-so-young, in backyards, in playgrounds, at the seashore, and other recreational areas. Exemplary of the prior art patents showing various of these aerodynamic toys are U.S. Pat. Nos. 2,659,178; Des. 183,626; Des. 241,565; 2,835,073; 3,082,572; 3,359,678; 3,566,532; 3,710,505; 3,828,466; 3,948,523; 3,724,122; 3,959,916; and 4,132,031.

Probably the more successful of the aerodynamic toys is shown in U.S. Pat. No. 3,359,678. As disclosed in that patent, the aerodynamic toy, or "flying saucer", comprises a rotatable free-flight body of generally circular configuration having a generally convex upper surface, and a generally concave bottom surface terminating at and integral with a circular rim portion. Air flow spoiling means, a unique feature of that invention, are provided on the upper convex surface adjacent the rim portion which comprises a plurality of circular, raised ribs, concentric with the geometric center of the aerodynamic toy.

In my earlier investigations, I discovered that the aerodynamic toy air spoilers need not necessarily be concentric, raised, ribs. The air spoilers, instead, can be radially extending, as disclosed in U.S. Pat. No. 4,132,031, which issued to me on Jan. 2, 1979. Although the radially extending air spoilers disclosed specifically in that patent are of somewhat limited configuration, there are disclosed other radially extending air spoilers of various configurations in my pending application, Ser. No. 959,995, filed Nov. 13, 1978, now U.S. Pat. No. 4,216,611. Moreover, in that application, I disclosed that optionally the aerodynamic toy can be further provided with air spoilers located in a centrally disposed assembly.

SUMMARY OF THE INVENTION

Now, I have discovered that spiral-shaped air spoilers on the convex upper surface of the aerodynamic toy provide an aerodynamic toy of good flight stability and aerodynamic lift.

Thus, there is provided in accordance with this invention, an aerodynamic toy comprising a rotatable free-flight body of generally circular configuration having a generally convex upper surface and a generally concave bottom surface, a downwardly extending rim portion integral with and defining the circumferential perimeter of the aerodynamic toy acting in flight as a primary air foil and at least one air spoiler having a spiral shape extending outwardly from centrally of the aerodynamic toy.

In the more preferred embodiment of the invention disclosed herein, the aerodynamic toy comprises a plurality of spiral-shaped air spoilers, these being defined by the involutes of a portion of a fixed curve, more preferably that of alternating arcs of a centrally disposed concentric circle. Thus, there are provided a plurality of spiral-shaped air spoilers which may be raised above the convex upper surface of the aerodynamic toy or be inscribed as grooves, each two adjacent ones of which are separated by a flat portion of the convex body.

While I do not wish, of course, to be limited to the explanation set forth herein, it appears that during flight, while the aerodynamic toy is rotating about its axis and is moving in a forward direction, air flow, at least in part, follows the path created by the spiral-shaped air spoilers. Thus, improved rotation of the aerodynamic toy results, and this in turn results in improved aerodynamic lift and flow of air over the upper convex surface.

BRIEF DESCRIPTION OF THE DRAWINGS

The invention will be better understood by referring to the drawings in which like numerals refer to like parts in the various view, and in which.

DETAILED DESCRIPTION OF THE INVENTION AND THE PREFERRED EMBODIMENTS

Figure 1:
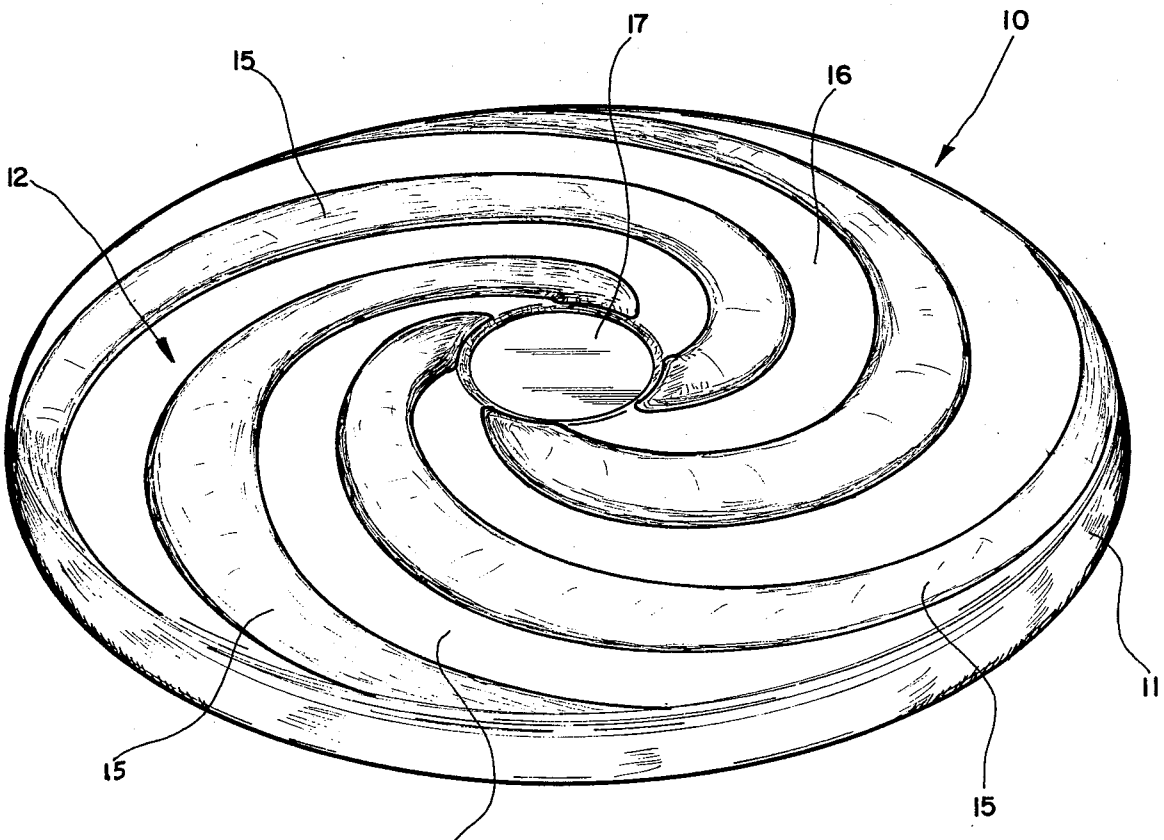
FIG. 1 is a view in perspective of an aerodynamic toy according to my invention.

Referring to the drawings, there is shown in FIG. 1 thereof an aerodynamic toy 10 in accordance with the invention comprising a rotatable, free-flight body of circular configuration defined by rim portion 11, integral with a main body portion 12. As shown in the drawing, main body portion 12 is of a generally convex-concave shape, the underneath concave surface 13 of which is smooth and uninterrupted, except as hereinafter more fully described.

On the upper convex surface 14 of aerodynamic toy 10 are provided a plurality of spiral-shaped, raised, air spoilers or elevations 15 which terminate, as shown, at rim portion 11. Between each two adjacent air spoilers 15, the convex surface 16 is smooth, thus providing alternating raised and flat surfaces. The spiral-shaped air spoilers 15 terminate at their inner ends at the circumference of a circular-shaped, depressed center portion 17.

Spiral-shaped air spoilers 15, as will be appreciated, by reference to FIG. 1, are defined by the involutes formed by successive 45° arcs of a circle of predetermined diameter. Every other involute is raised in arcuate cross-section, as shown, above the convex upper surface 14 of the aerodynamic toy body 12. Thus, between each two adjacent raised spirals, or air spoilers 15, there is a flat spiral formed of an involute of the same width and shape as the raised one; or, if you prefer, between each two flat spirals, or involutes, there is a spiral in raised elevation.

The involutes which define spiral-shaped air spoilers 15 can be, of course, of various widths, as desired, from that of essentially a point on the circle formed by depressed, circular center portion 17, to that, for example, defined by a 135° arc. Dividing a circle into 360 one-degree arcs will result in 360 involutes, providing 180 spiral-shaped elevations alternating with 180 spiral-shaped flat spaces. In the case of the embodiment shown in FIG. 1, circle 17 is divided into eight 45° arcs. It will be found, however, that good performance will result when from one to nine raised involutes, or spiral-shaped elevations 15, are provided on the aerodynamic toy. Although in FIG. 3 of the drawing, spiral-shaped elevations 15 are seen to be of arcuate, or convex, cross-section, this need not necessarily be the case. These elevations can be of other cross-sectional configuration, for example, the leading, or outer, edge higher than the trailing edge with the elevation surface relatively flat and tapering downwardly from the leading edge to the trailing edge.

The involutes need not be formed from equal arcs. For example, the perimeters of the raised elevations can be defined by involutes of arcs of greater or lesser degree than the involutes defining the spiral-shaped flat portion between the raised elevations. The raised elevations can be defined, by example, involutes of 45° and the flat portions between adjacent raised elevations defined by involutes of arcs of 135°. Only two raised spirals, in this case, would be formed, 180° apart. Instead of involutes defining raised elevations, the involutes can, if desired, define spiral-shaped grooves inscribed in the upper convex surface 14. The involutes can, of course, although not shown in any of the figures of the drawing, be formed so as to spiral in the opposite directions.

The spiral curves forming air spoilers 15 in FIG. 1 are defined, as shown, by the involutes of a circle; however, this need not necessarily be the case. Involutes can be formed from any fixed curve, e.g., polygons or circles as desired. The main thing is that the polygon be centrally disposed so as to be concentric to the geometric center of the aerodyamic toy. Thus, instead of a centrally disposed depressed circle, a depression of polygonal shape in cross-section could be provided.

Figure 2:
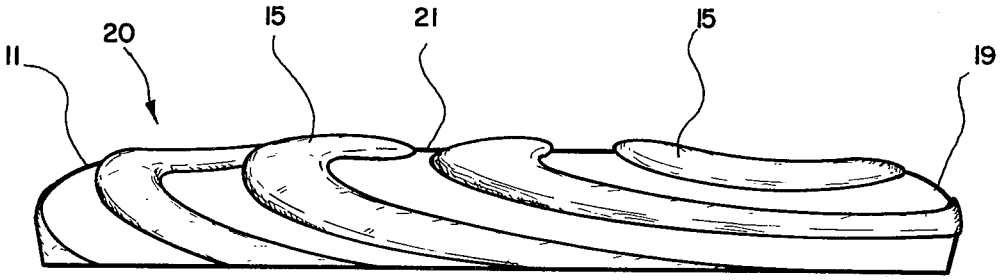
FIG. 2 is a view in side elevation of another embodiment of the invention.

In FIG. 2 of the drawing, there is shown a slightly different embodiment of an aerodynamic toy 20 in accordance with the invention. The involutes in this case are of arcs of a circle 21 in the plane of the convex upper surface 14, concentric with the geometric center of the aerodynamic toy. Moreover, in this embodiment, contrary to that shown in FIG. 1, spiral shaped air spoilers 15 do not terminate at the juncture between rim portion 11 and convex/concave body 12. Instead, as shown, the involutes extend to the bottom of rim portion 11, thus providing further spoiling of the air than that provided generally by the primary air foil formed only by rim portion 11. Nevertheless, it will be appreciated that the spiral-shaped air spoilers 15 can be terminated at any point desired on the convex body.

Figure 3:
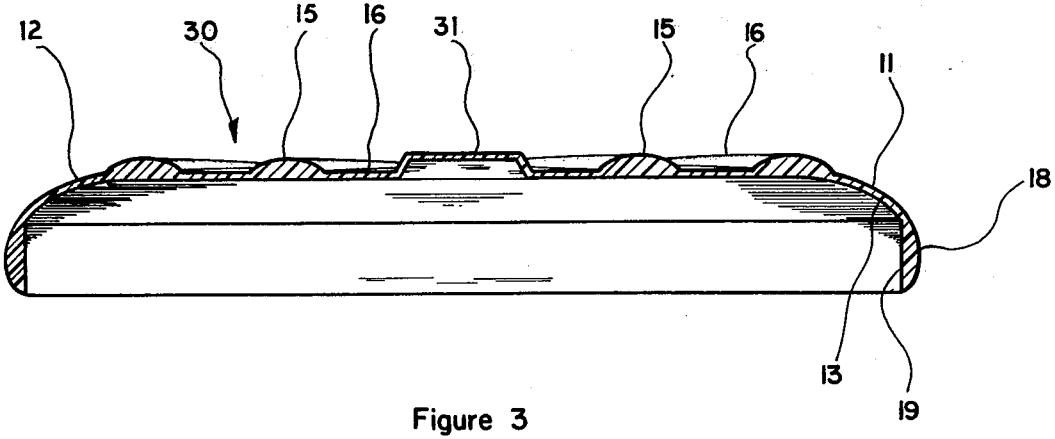
FIG. 3 is a view in cross-section showing still another embodiment of an aerodynamic toy according to the invention.

Turning now to FIG. 3 of the drawing, there is shown therein a diametric cross-section of still a further embodiment of an aerodynamic toy 30, according to the invention. In this embodiment, the spiral-shaped air spoilers 15 terminate at rim portion 11, as in FIG. 1. Central portion 31, however, is of a raised cylindrical configuration, the top planar surface of which is only slightly higher than the spiral shaped air spoilers at their inner end. Rim portion 11 of aerodynamic toy 30, as is the case with the aerodynamic toys 10, 20 shown in FIGS. 1 and 2, is provided integral with main body portion 2, and forms a downwardly turned smooth curve continuous with the generally convex upper surface 14. As indicated in the drawing, the outside surface 18 of rim portion 11 curves downwardly and somewhat inwardly, approximating the shape of a parabola opening inwardly toward the central axis of the saucer-shaped body of the aerodynamic toy 30.

The inner surface 19 of rim portion 11 can take the same curved shape as outer surface 18; however, in general, it is desirable not to provide this inner surface even though curved inwardly, parallel to outer surface 18. The rim portion 11 is desirably thicker than the main body portion 12, to provide a greater density in the rim portion. This makes for better stability of the aerodynamic toy, as it gives the toy direction, and sustains flight in the direction the toy was propelled.

The inner surface 19 of rim portion 11 can, if desired, be in part curved, nearer the concave surface 13 of main body portion 12, and then flat. Thus, an approximately cylindrical-shaped inner surface 19 can be provided in rim portion 11, essentially concentric with the axis of the geometric center of the aerodynamic toy. In this manner, a rim portion 11 of substantial thickness can be provided, to provide in the larger diameter aerodynamic toy, particularly, a rim portion of much greater weight, when greater weight is desired.

Aerodynamic toys in accordance with the invention can be manufactured readily by conventional molding techniques, e.g., injection molding, and from various plastic materials such as polyvinylchloride, polyethylene, polypropylene and the like. The plastic compositions can incorporate various of the conventional compounding agents to alter the physical properties of the plastic material, as desired, e.g., density, flexibility, hardness, etc. Coloring agents can be included to provide any suitable color or combination thereof, as desired. Quite desirably the spiral-shaped air spoilers will be of a contrasting color to the aerodynamic toy body.

To facilitate manufacture, inner surface 19 can have a slight draft as shown. This will enable the aerodynamic toy to be more readily extracted from the mold. Also, it will be appreciated that, if desired, underneath concave surface 13 can be provided with concave spirals coincident with convex spiral-shaped air-spoilers 15 on convex body 12. This will not only result in some savings of materials of manufacture but also facilitate manufacture.

It is, of course, desirable that the aerodynamic toy be of relatively light weight; however, it should not be so light as to adversely effect its performance. The optimum weight for any particular aerodynamic toy will depend somewhat upon its particular size, i.e., diameter. Where the spiral-shaped air spoilers are raised elevations, as shown in the figures of the drawing, this will, of course, add to the overall weight and thickness of the toy, and this should be taken into account. For example, where the aerodynamic toy is 10.5" in diameter, a weight of about 1.8 grams/cubic inch volume displacement will be found satisfactory. In such an aerodynamic toy, the convex/concave body can be about 3/64" thick in the flat areas between the raised, spiral-shaped air spoilers. The aerodynamic toy in this case will have a thickness at the peak of an air spoiler of about 5/64". It will be appreciated that the drawings are somewhat exaggerated for sake of clarity. The spiral-shaped air spoilers shown in the drawings are convex in cross-section, and form a smooth curve with the flat areas between adjacent air spoilers. In this case, a center, circular portion of 1⅞" diameter, defining involutes of 45° arcs will be found satisfactory. If the spiral-shaped air spoilers are defined by grooved involutes, the thickness of the aerodynamic toy should, of course, be somewhat greater in the flat areas than indicated above.

The depressed or raised center portion of the aerodynamic toy can be of a right cylindrical shape, rather than a truncated cone, as shown in FIG. 3. In the case of a depressed central portion, the sides can slope inwardly or outwardly, as desired. The depth of the depressed center portion can, of course, be varied, for example, from 1/16" to ½". When a raised central portion is provided, it desirably should not be substantially higher than the thickness of the spiral-shaped air spoilers. As in the case of the depressed center portion, however, the sides can be vertical or slope outwardly from top to bottom, e.g., at a 30° angle with respect to the convex upper surface. The central circle can be, of course, of various diameters, as desired. The circle can even be merely a centrally located dot or circle of very small diameter. The smaller the diameter of the central circular portion, the longer will be, of course, the spiral-shaped air spoilers, and the tighter the spiral.

In use, the aerodynamic toy of the invention is gripped by placing the thumb on the convex side of the toy and one or more of the fingers of the hand on the concave side. The toy is then thrown into the air with a twist of the wrist to give the aerodynamic toy a spinning impetus thereby causing it to rotate about its geometric center and to translate generally in the direction in which it is thrown. Throwing is accomplished in general by holding the aerodynamic toy horizontal to the ground.

In practice, the spiral-shaped air spoilers appear to perform three functions: they distribute air flow over the convex upper surface; they act as secondary air foils while the aerodynamic toy is in rotary and lateral motion, and they also serve as air spoilers. Moreover, the central portion not only serves as a terminal point of the spiral-shaped air spoilers/foils, but also functions as a spoiler.

As many different embodiments of this invention will now occur to those skilled in the art, it is to be understood that the specific embodiments of the invention as presented in this patent application are intended by way of illustration only and are not limiting on the invention, but that the limitations thereon should be determined only from the appended claims.

I claim:

1. An aerodynamic toy comprising a rotatable free-flight body of generally circular configuration comprising a main body portion having a generally convex upper surface and a generally concave bottom surface, a downwardly extending rim portion integral with said main body portion and defining the circumferential perimeter of the aerodynamic toy which acts in flight as a primary air foil, said rim portion having an outside surface which curves downwardly and somewhat inwardly and at least one spiral-shaped air spoiler on said convex upper surface extending outwardly from centrally of the aerodynamic toy, said at least one spiral-shaped air spoiler being defined by an involute of a predetermined fixed curve located centrally of the aerodynamic toy.

2. An aerodynamic toy comprising a rotatable free-flight body of generally circular configuration comprising a main body portion having a generally convex upper surface and a generally concave bottom surface, a downwardly extending rim portion integral with said main body portion and defining the circumferential perimeter of the aerodynamic top which acts in flight as a primary air foil, said rim portion having an outside surface which curves downwardly and somewhat inwardly and at least one spiral-shaped air spoiler on said convex upper surface extending outwardly from centrally of the aerodynamic toy.

3. An aerodynamic toy according to claim 1 wherein said fixed curve is a polygon of predetermined size located at the geometric center of the aerodynamic toy.

4. An aerodynamic toy according to claim 1 wherein said fixed curve is a circle of predetermined diameter whose center coincides with the geometric center of the aerodynamic toy.

5. An aerodynamic toy according to claim 4 wherein the at least one spiral-shaped air spoiler is defined by the involute formed by a predetermined arc of the said circle of the said predetermined diameter.

6. An aerodynamic toy according to claim 5 wherein the at least one spiral-shaped air spoiler comprises a plurality of air spoilers defined by the plurality of involutes formed by a plurality of predetermined arcs alternating one after the other about the circumference of a circle of predetermined diameter.

7. An aerodynamic toy according to claim 6 wherein the said predetermined arcs are at least one degree.

8. An aerodynamic toy according to claim 7 wherein the said air spoilers are involutes which comprise raised elevations above the generally convex upper surface, and between said raised elevations are flat involutes alternating with the raised involutes.

9. An aerodynamic toy according to claim 8 wherein the raised elevations are of convex shape in cross-section.

10. An aerodynamic toy according to claim 7 wherein the involutes comprise grooves inscribed in the generally convex upper surface of the aerodynamic toy.

11. An aerodynamic toy according to claim 9 wherein the raised elevations each terminate at the point where the rim portion joins with the upper convex surface.

12. An aerodynamic toy according to claim 4 wherein said circle defines a circular-shaped depression in the convex upper surface of the aerodynamic toy.

13. An aerodynamic toy according to claim 4 wherein said circle defines a raised portion above the convex upper surface of the aerodynamic toy.

14. An aerodynamic toy according to claim 6 wherein the said predetermined arcs are of equal degrees.

15. An aerodynamic toy according to claim 8 wherein the said air spoilers are defined by involutes formed by successive 45° arcs of said circle of predetermined diameter.

16. An aerodynamic toy according to claim 8 wherein said air spoilers are defined by alternating involutes which are defined by arcs of said circle of different degrees.

17. An aerodynamic toy according to claim 8 wherein the said leading edge of the raised elevation is higher than the trailing edge.

* * * * *